US006002374A

United States Patent [19]

Nicholas

[11] Patent Number: 6,002,374

[45] Date of Patent: Dec. 14, 1999

[54] DISK ANTENNA

[75] Inventor: Melvin Nicholas, P.O. Box 2894, Jacksonville, Fla. 32203

[73] Assignee: Melvin Nicholas, Jacksonville, Fla.

[21] Appl. No.: 09/062,688

[22] Filed: Apr. 20, 1998

[51] Int. Cl.[6] ..... H01Q 3/00

[52] U.S. Cl. ..... 343/725; 343/880; 343/890; 343/874

[58] Field of Search ..... 343/897, 725, 343/727, 875, 878, 880, 881, 882, 883, 874, 890, 891, 892, 893

[56] References Cited

U.S. PATENT DOCUMENTS

| | | | |
|---|---|---|---|
| 2,846,678 | 8/1958 | Best | 343/727 |
| 5,281,975 | 1/1994 | Hugo | 343/766 |
| 5,517,204 | 5/1996 | Murakoshi et al. | 343/765 |
| 5,604,508 | 2/1997 | Atkinson | 343/879 |
| 5,793,336 | 8/1998 | Shoemaker et al. | 343/795 |

*Primary Examiner*—Hoanganh Le
*Assistant Examiner*—James Clinger

[57] ABSTRACT

A disk antenna (10) has a base (12). The disk antenna (10) further has a hollow post (14) which is securely fastened at a bottom distal end to the base extending upwardly therefrom. The post (14) has a post base (14A). The post base (14A) is securely connected at a bottom distal end to the base (12) and rotatably connected at a top distal end to a bottom distal end of a post head swivel (14BA) which is rotatably connected at a top distal end to a bottom distal end of a post head (14B) which is securely connected at a top distal end to the dish (16). The disk antenna (10) further has a dish (16). The dish (16) has a dish plate (16A) having a dish cone (16B) centrally located therein. The dish (16) is securely attached to a top distal end of the post (14). The disk antenna (10) further has a primary antenna (18A) which is securely fastened to the dish (16). The secondary right antenna (18B) further has a secondary right antenna bracket (18BA) which functions to permit adjustment of the secondary right antenna (18B). The disk antenna (10) further has at least one secondary left antenna (18C) which is securely fastened to the dish (16). The disk antenna (10) further has a cable (20) electrically connected to the dish cone (16B) and the primary antenna (18A) and the at least one secondary antenna.

4 Claims, 4 Drawing Sheets

DISK ANTENNA

BACKGROUND OF THE INVENTION

1. Field of the Invention

The present invention relates to an antenna for receiving electromagnetic signals. More particularly, the present invention relates to enhancing the signal received.

2. Description of the Prior Art

TV antennas are well known in the art and are described in a number of configurations. Receiving VHF and UHF signals requires two antennas which are often pointed to several locations. The typical installation is to mount the antennas on the roof of a building. What is needed is a single mounting device which is supported off of the floor and supports several antennas which are optimized to enhance signals in a plurality of signal frequency ranges.

Numerous innovations for disk antenna have been provided in the prior art that are described as follows. Even though these innovations may be suitable for the specific individual purposes to which they address, they differ from the present invention as hereinafter contrasted.

In U.S. Pat. No. 4,814,781, titled, Satellite dish drive mechanism, by inventor, Deaden, an improved drive for a satellite dish assembly. A flat, steel arc is fixedly connected at its two ends to the pivotal frame of the dish assembly, which steel arc is provided with a series of rows of mini-gear teeth on its outer surface. The steel arc is sandwiched between a rotatable knurled hub and a roller bearing, which knurled hub is provided with a series of rows of mini-diamond-shaped recesses for meshing engagement and forming of the gear teeth of the steel arc, in order to pivot the steel arc, and, therefore, the frame and dish mounted thereto, through a desired arc for aiming the satellite dish. The knurled hub is driven by a motor assembly, the motor assembly, knurled hub, and bearing being mounted to a free end of a cantilevered support arm, the other end of which is fixedly connected to a housing for the pivot shaft of the dish assembly about which the frame and satellite dish rotate for aiming purposes.

The patented invention differs from your invention because the patented invention describes and claims a fixedly connected flat steel arc, a knurled hub, and a pivot shaft which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

In U.S. Pat. No. 4,783,662, titled, Polar mount for satellite dish antenna by inventor, Wart, Jr., et. al., a polar mount for a satellite dish antenna has the flattened ends of three metal tubes bolted together to form a triangular base having three corners. Three tubular leg members have their corresponding lower flattened ends joined to the respective corners of the base. One leg member constitutes the polar axis shaft. The other two leg members are telescopic and adjustable in length. The upper ends of the two telescopic leg members and the upper end of the polar axis shaft are connected at a common point to create a pyramid-shaped structure. Brackets having bearings mounted to the outside back of the dish and the polar axis shaft extends through these bearings along an axis aligned with a diameter of the dish. The polar axis shaft is at an angle with respect to horizontal corresponding to the degrees of latitude at the antenna location. A tangent to the dish axis is at a declination offset angle relative to the polar axis shaft. The dish rotates on the polar axis shaft through a look angle. The latitude angle is obtainable by bending the polar axis tubular shaft at its flattened end while the other two legs extend or contract. The shaft is direct able exactly to true north by shifting said common connection laterally which is accommodated by one of said leg members extending and the other contracting.

The patented invention differs from your invention because the patented invention describes and claims polar mount, three metal tubes, triangular base having three corners, three tubular leg members, and two telescopic leg members which differs from your invention which has the following features: Disk Swivel Head, Outer Section, One Intersection, Head Base for the Disk, Support Beam, Base Section, Hole in Disk one for Disk Connection to the Swivel Head, and Three Antennas, One on the Disk and Two on the Swivel Head.

In U.S. Pat. No. 4,626,864, titled, Motorized antenna mount for satellite dish by inventor, Micklethwaite, a motorized antenna mount for rotationally and pivotally supporting a satellite dish on a main vertical support pole. A base is adjustably mounted on the top of the support pole by a plurality of plumb bolts to compensate for any vertical misalignment of the pole. A motor housing is pivotally mounted on the base by a hinge and pair of curved pivot guide tracks. An electric motor is mounted in the motor housing and is connected to a drive gear through a gear reducer for rotating a turret which is mounted by a thrust bearing on turret mount attached to the top of the motor housing. The satellite dish is mounted on the end of a support arm which is pivotally adjustably mounted on the turret for declination angle control thereof. The turret has an internal arcuate-shaped gear track extending preferably 180 deg. about a central opening formed in the interior of the turret and engageable with the motor for rotating the turret drive gear. A pair of set bolts are mounted on the turret to pivotally adjust the declination angle of the dish support arm. The improved mount provides both course and fine pivotal adjustment for the dish supporting arm and particularly provides a motorized drive for rotating the dish to any desired rotational position for accurately positioning the dish for a selected satellite.

The patented invention differs from your invention because the patented invention describes and claims base is adjustably mounted on the top of the support pole, motor housing is pivotally mounted on the base by a hinge and pair of curved pivot guide tracks, and a motor housing connected to a drive gear through a gear reducer for rotating a turret, which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

In U.S. Pat. No. 4,598,297, titled, Mounting apparatus for satellite dish antennas by inventor, Hawkins, a mounting apparatus is illustrated for a TV satellite dish antenna wherein nonbinding adjustment means are provided for accommodating the dish antenna for use in particular geographical location, and wherein means are provided for mounting dish antennas upon a tiltable frame wherein bracket supports are adjustable so that a leg may be accommodated in tangential relation to any selected dish size and configuration.

The patented invention differs from your invention because the patented invention describes and claims a nonbinding adjustment means, mounting dish antennas upon a tiltable frame, and bracket supports are adjustable which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

In U.S. Pat. No. 4,126,865, titled, Satellite tracking dish antenna by inventor, Longhurst, et. al., in a small satellite earth station a directional antenna is rocked about a single axis, corresponding to an oscillatory change in declination, but constant hour angle. The rocking is approximately sinusoidal and has a period of one sidereal day. In a preferred arrangement the antenna is mounted on a rocking axis pivot which is fixed at right angles to, and rotatable for adjustment about, a polar axis member. The polar axis member is set up parallel to the earth's axis and the pivot is rotated about the polar axis member to set the hour angle. The rocking of the antenna is achieved by a crank and tie-rod arrangement driven by a clock motor mounted on the polar axis member. The arrangement is particularly simple and will, when set up, track a synchronous satellite without needing frequent adjustment.

The patented invention differs from your invention because the patented invention describes and claims a directional antenna, rocking axis pivot, polar axis member, and crank and tie-rod arrangement driven by a clock motor which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

In U.S. Pat. No. 5,552,796, titled, VHF, UHF antenna an antenna for receiving UHF and VHF TV frequency signals provides a good impedance match and a wide frequency band of operation to the TV set. The antenna includes a telescoping cylindrical monopole antenna element rotatably mounted to a support structure and a multi-turn helical antenna element, each turn being rotatably mounted to the support structure. A first lead, at a first end of the transmission line, is coupled to the telescoping monopole antenna element and a second lead, of the twin-lead transmission line, is coupled to the helical antenna element. A second end of the twin-lead transmission can be coupled to a TV set for clear reception of the VHF and UHF TV signals.

The patented invention differs from your invention because the patented invention describes and claims a telescoping cylindrical monopole antenna element, support structure, multi-turn helical antenna element, twin-lead transmission line, and a helical antenna element which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

In U.S. Pat. No. 5,541,611, titled, VHF/UHF television antenna by inventor, Peng, et. al., a flat planar antenna formed from a flat this substrate coated on one surface with a electrically conductive material except for a first uncoated funnel shaped cavity with a large mouth beginning along one outer surface of the substrate and diminishing in cross-section toward the center of the substrate with a diminishing width down to an extended neck portion which extends to an outer substrate surface normal or parallel to the substrate surface adjacent to the mouth. A smaller tuning cavity may be positioned over the neck portion adjacent to the edge of the substrate. The antenna may have feed lines plated on the opposite surface from the funnel shaped cavity, hard wired through the substrate to the opposite side thereof or formed by micro stripline techniques. A second embodiment employs unplated side cavities between the funnel unplated area and the edges of the substrate normal to the funnel mouth.

The patented invention differs from your invention because the patented invention describes and claims a flat planar antenna which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

In U.S. Pat. No. 5,436,675, titled, Television receiver with UHF/VHF and broadcast satellite tuners, power switch state, and external decoder output and input terminals by inventor Hayashi, et. al., a display antenna reception level display television receiver capable of displaying the condition, i.e., ON or OFF, of the power supply which supplies electric power to an external BS (broadcasting satellite) reception converter, together with the reception level at the BS antenna. The level at the antenna is detected by a level detector circuit (27) according to the output from a BS tuner (23) and displayed on the CRT (36). A power supply circuit (20) which supplies electric power to the external BS converter is switched on by a power switch (46). A system controller (41) detects the condition of this power switch and displays this condition together with the antenna reception level.

The patented invention differs from your invention because the patented invention describes and claims a display antenna reception level display television receiver capable of displaying the condition which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel head.

In U.S. Pat. No. 4,667,204, titled, Combination dual rhombic and V-type antenna for VHF-UHF television receivers by inventor, Hedrick, a combination of two juxtaposed rhombic antennas and a V-antenna on a single, longitudinal, non-conductive support boom. The two rhombic antennas lie flat upon one another in substantially the same plane and are supported on the boom with insulating transverse spreader rods.

The patented invention differs from your invention because the patented invention desribes and claims two juxtaposed rhombic antennas, and a longitudinal non-conductive support which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

In U.S. Pat. No. 3,931,626, titled, Staggered tuned TV receiving antenna with integrated UHF-VHF sections, by inventor Simons, a TV antenna having integrated UHF-VHF sections and designed to favorably respond to at least two widely spaced frequencies. The dipoles of the antenna are arranged in a staggered tuned array mounted on a pair of conductive cross-arms. The rearmost dipole is provided with a paddle-shape dipole that can be adjusted for ½ wavelength response at the lower of the two frequencies by varying the perimeter of the paddle, and the higher frequency is tuned in by adjusting the 3/2 wavelength response by varying the length of the inboard conductor.

The patented invention differs from your invention because the patented invention describes and claims a TV antenna having integrated UHF-VHF sections which differs from your invention which has the following features: Disk Swivel Head, Outer Section, One Intersection, Head Base for the Disk, Support Beam, Base Section, Hole in Disk Cone for Disk Connection to the Swivel Head, and Three Antennas, One on the Disk and Two on the Swivel Head.

Numerous innovations for disk antenna have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a disk antenna which is attached on one end of a post by a post head swivel. The opposite end of the post is attached to a base which rests on the floor. The base has a counter weight to add stability. The disk antenna has a dish with a receiver functioning to receive UHF signals. A pair of antennas attached to the rear of the dish and projecting upward function to receive VHF signals. A cable functions to carry VHF and UHF signals from the antenna to the TV.

The types of problems encountered in the prior art are supporting and aiming a VHF antenna and a UHF antenna.

In the prior art, unsuccessful attempts to solve this problem were attempted namely: roof mounted antennas which a subject to environment effect and degradation of signal due to atmospheric conditions. However, the problem was solved by the present invention because the antennas are mounted in side on a support pole.

The present invention solved a long felt need for an antenna which enhances the signal pickup.

A synergistic effect was produced utilizing the present invention due to the present invention being mounted on a post which is supported by a base. The present invention may be mounted inside a building out of the weather.

Accordingly, it is an object of the present invention to provide a support post which is attached to a base containing a counter weight.

More particularly, it is an object of the present invention to provide a dish which is repositionable by the user.

In keeping with these objects, and with others which will become apparent hereinafter, one feature of the present invention resides, briefly stated, in a combined VHF and UHF receivers which are independently pointable and have enhanced reception.

When the disk antenna is designed in accordance with the present invention, signal reception is improved.

In accordance with another feature of the present invention, the disk antenna is swively mounted at top a post.

Another feature of the present invention is that the post is stabilized by a counter weight.

Yet another feature of the present invention is that the dish has a dish plate and a dish cone.

16BA—dish cone opening (16BA)

16C—dish swivel (16C).

Still another feature of the present invention is that a dish cone has a dish cone opening.

Yet still another feature of the present invention is that a primary antenna is attached to a primary antenna base.

Still yet another feature of the present invention is that a secondary right antenna is attached by a secondary right antenna bracket to a post head swivel.

Another feature of the present invention is that a secondary left antenna is attached by a secondary left antenna bracket to post head swivel.

Yet another feature of the present invention is that a cable is attached to both antennas and functions to carry a received signal from the primary antenna, and a secondary left antenna to a receiver means, preferably a TV.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—disk antenna (10)
12—base (12
12A—base housing (12A)
12B—base insert (12B)
12C—base weight (12C)
12D—base opening (12D)
14—post (14)
14A—post base (14A)
14B—post head (14B)
14BA—post head swivel (14BA)
14C—post access cover (14C)
16—dish (16)
16A—dish plate (16A)
16B—dish cone (16B)
16BA—dish cone opening (16BA)
16C—dish swivel (16C)
18A—primary antenna (18A)
18AA—primary antenna base (18AA)
18B—secondary right antenna (18B)
18BA—secondary right antenna bracket (18BA)
18C—secondary left antenna (18C)
18CA—secondary left antenna bracket (18CA)
20—cable (20)

DESCRIPTION OF THE PREFERRED EMBODIMENT

Figure 1:
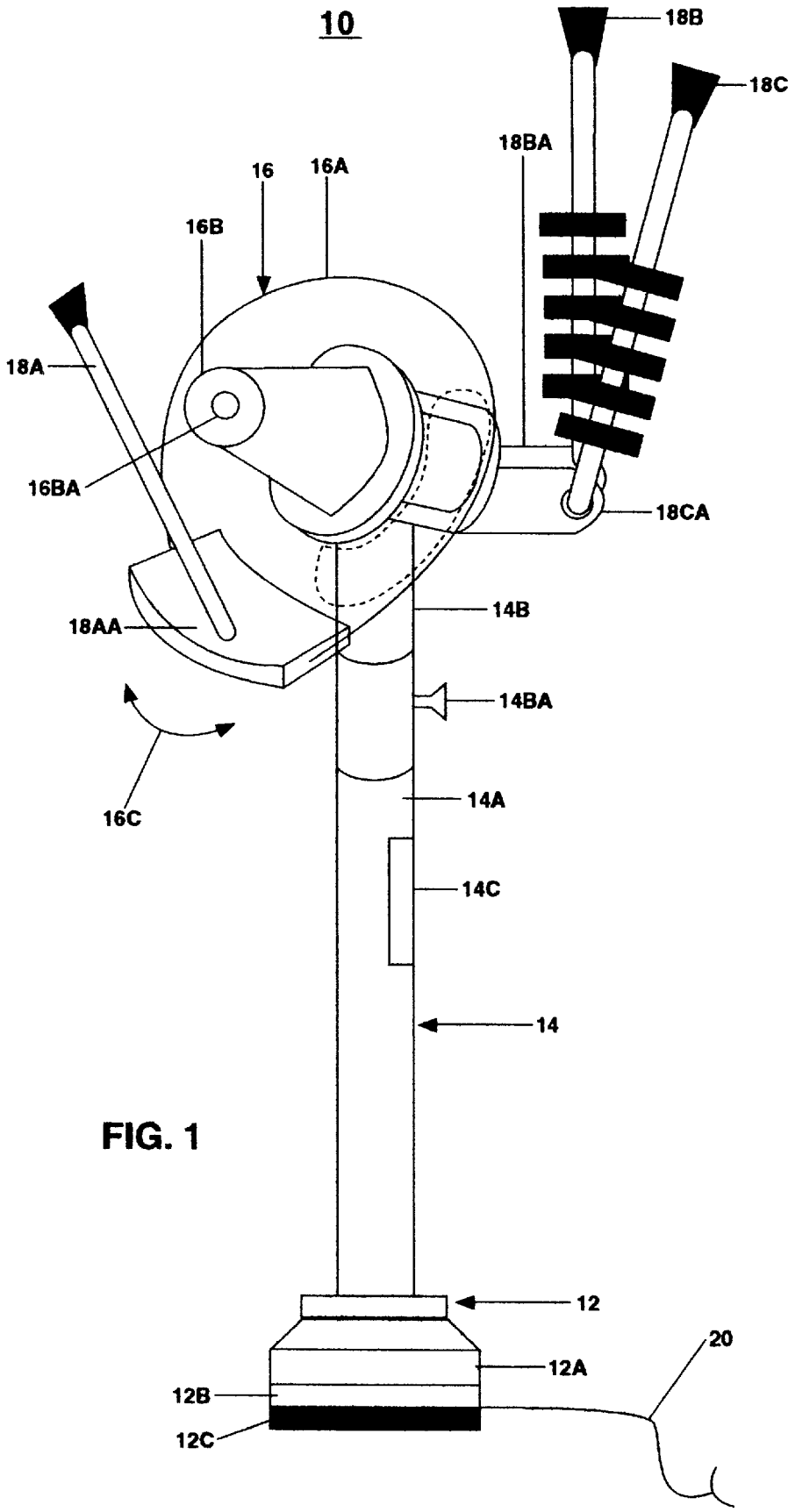
FIG. 1 is a left top perspective view of a disk antenna.

Firstly, referring to FIG. 1 which is a left top perspective view of a disk antenna (10). The disk antenna (10) comprises a base (12). The base (12) comprises a base housing (12A) with a base insert (12B) removably insertable therein, the the base (12) further comprises a base weight (12C) securely attached to a bottom surface of the base insert (12B). The base (12) further comprises a base opening (12D) in communication with the hollow post (14). The base opening (12D) functions to receive a cable (20) therethrough.

The disk antenna (10) further comprises a hollow post (14) which is securely fastened at a bottom distal end to the base extending upwardly therefrom. The post (14) comprises a post base (14A). The post base (14A) is securely connected at a bottom distal end to the base (12) and rotatably connected at a top distal end to a bottom distal end of a post head swivel (14BA) which is rotatably connected at a top distal end to a bottom distal end of a post head (14B) which is securely connected at a top distal end to the dish (16). The post (14) further comprises a post access cover (14C).

The disk antenna (10) further comprises a dish (16). The dish (16) comprises a dish plate (16A) having a dish cone (16B) centrally located therein. The dish cone (16B) further comprises a dish cone opening (16BA) longitudinally disposed therein which functions to accept a fastener which attaches the dish cone (1613) to the dish plate (16A). The dish (16) is securely attached to a top distal end of the post (14). The dish (16) is rotatably connected to the post (14) permitting dish swivel (16C).

The disk antenna (10) further comprises a primary antenna (18A) which is securely fastened to the dish (16). The primary antenna (18A) comprises a primary antenna base (18AA) which is securely attached to the dish plate (16A). The secondary right antenna (18B) further comprises a secondary right antenna bracket (18BA) which functions to permit adjustment of the secondary right antenna (18B).

The disk antenna (10) further comprises at least one secondary left antenna (18C) which is securely fastened to the dish (16). The secondary left antenna (18C) further comprises a secondary left antenna bracket (18CA) which functions to permit adjustability of the secondary left antenna (18C).

The disk antenna (10) further comprises a cable electrically connected to the dish cone (16B) and the primary antenna (18A) and the at least one secondary antenna.

Figure 2:
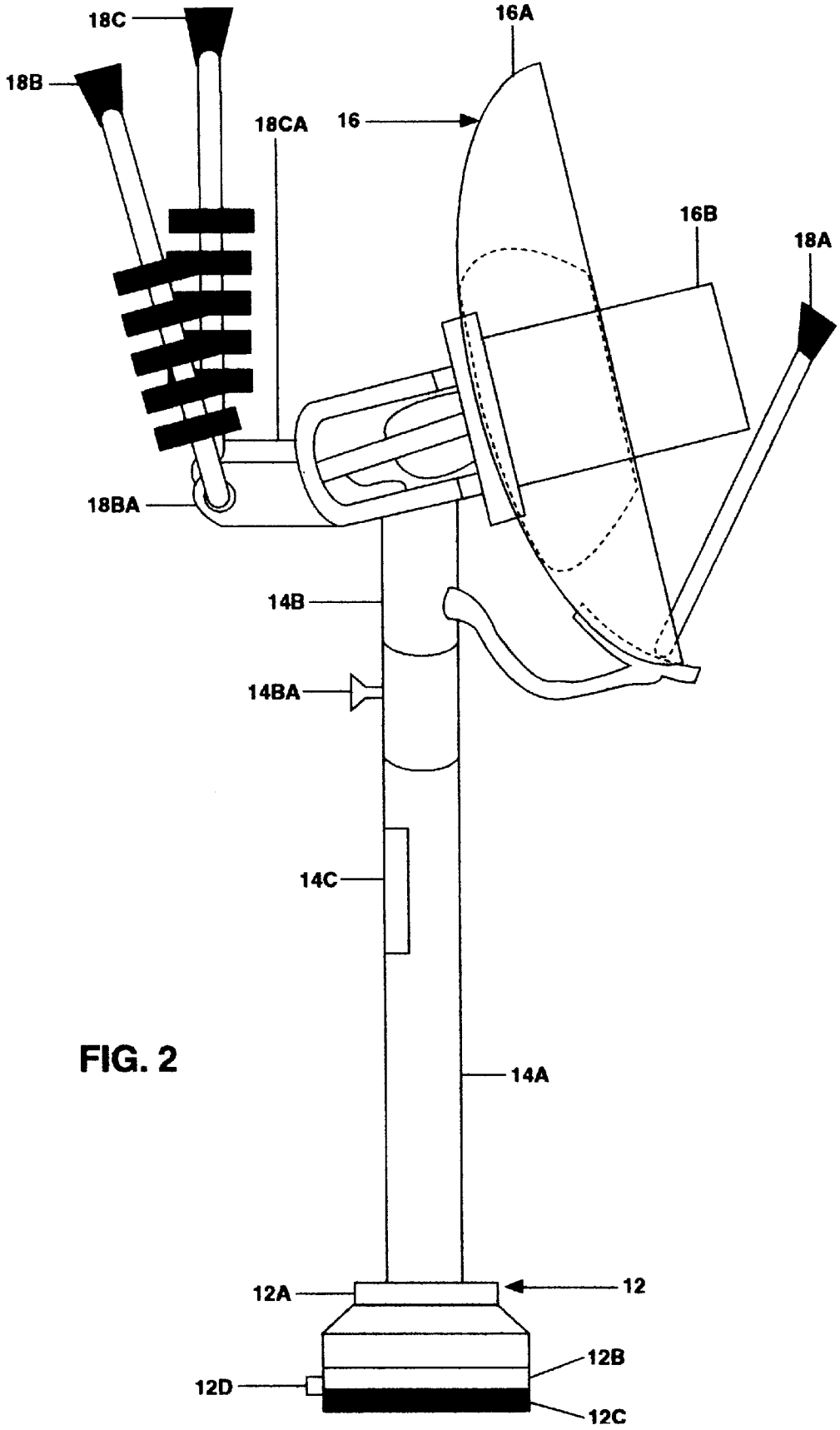
FIG. 2 is a right side view of a disk antenna.

Secondly, referring to FIG. 2 which is a right side view of a disk antenna (10). The disk antenna (10) comprises a base (12). The base (12) comprises the base housing (12A) with the base insert (12B) removably insertable therein. The base (12) further comprises the base weight (12C) which is securely attached to a bottom surface of the base insert (12B). The base (12) further comprises the base opening (12D) in communication with the hollow post (14). The base opening (12D) functions to receive a cable (20) therethrough.

The disk antenna (10) further comprises the hollow post (14) which is securely fastened at the bottom distal end to the base extending upwardly therefrom. The post (14) comprises the post base (14A). The post base (14A) is securely connected at the bottom distal end to the base (12) and rotatably connected at a top distal end to a bottom distal end of the post head swivel (14BA) which is rotatably connected at the top distal end to a bottom distal end of the post head (14B) which is securely connected at the top end to the dish (16). The post (14) further comprises the post access cover (14C).

The disk antenna (10) further comprises the dish (16). The dish (16) comprises the dish plate (16A) having the dish cone (16B) centrally located therein. The dish cone (16B) further comprises the dish cone opening (16BA) longitudinally disposed therein which functions to accept the fastener which attaches the dish cone (16B) to the dish plate (16A). The dish (16) is securely attached to the top distal end of the post (14). The dish (16) is rotatably connected to the post (14) permitting the dish to swivel.

The disk antenna (10) further comprises the primary antenna (18A) which is securely fastened to the dish (16). The primary antenna (18A) comprises the primary antenna base (18AA) which is securely attached to the dish plate (16A). The secondary right antenna (18B) further comprises the secondary right antenna bracket (18BA) which functions to permit adjustment of the secondary right antenna (18B).

The disk antenna (10) further comprises at least one secondary left antenna (18C) which is securely fastened to the dish (16). The secondary left antenna (18C) further comprises the secondary left antenna bracket (18CA) which functions to permit adjustability of the secondary left antenna (18C).

The disk antenna (10) further comprises a cable (20) electrically connected to the dish cone (16B) and the primary antenna (18A) and the at least one secondary antenna.

Figure 3:
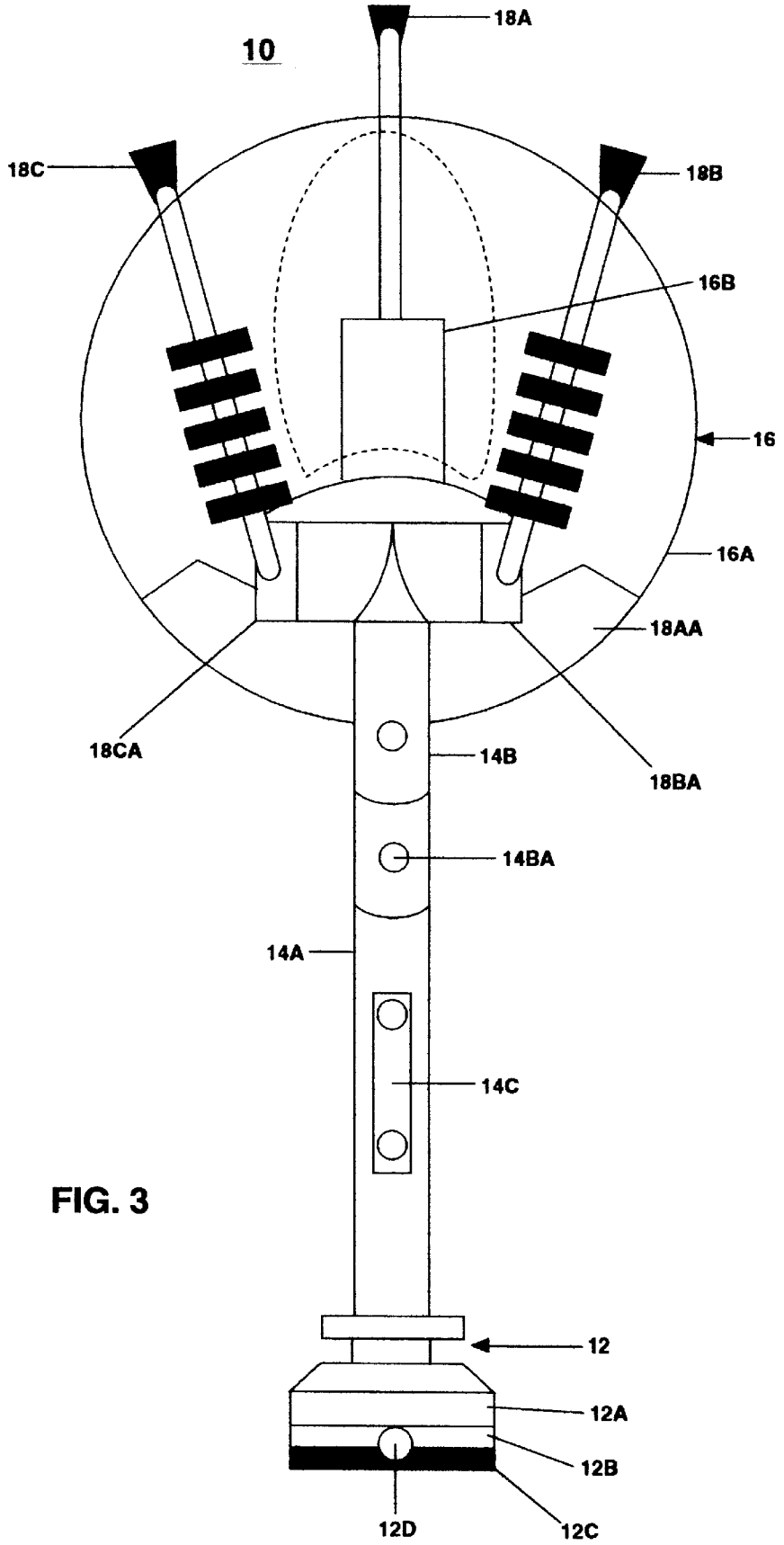
FIG. 3 is a rear view of a disk antenna.

Thirdly, referring to FIG. 3 which is a rear view of a disk antenna (10). The disk antenna (10) comprises a base (12). The base (12) comprises the base housing (12A) with the base insert (12B) removably insertable therein. The base (12) further comprises the base weight (12C) which is securely attached to a bottom surface of the base insert (12B). The base (12) further comprises the base opening (12D) in communication with the hollow post (14).

The disk antenna (10) further comprises the hollow post (14) which is securely fastened at the bottom distal end to the base extending upwardly therefrom. The post (14) comprises the post base (14A). The post base (14A) is securely connected at the bottom distal end to the base (12) and rotatably connected at a top distal end to a bottom distal end of the post head swivel (14BA) which is rotatably connected at the top distal end to a bottom distal end of the post head (14B) which is securely connected at the top distal end to the dish (16). The post (14) further comprises the post access cover (14C).

The disk antenna (10) further comprises the dish (16). The dish (16) comprises the dish plate (16A) having the dish cone (16B) centrally located therein. The dish (16) is securely attached to the top distal end of the post (14). The dish (16) is rotatably connected to the post (14) permitting the dish to swivel.

The disk antenna (10) further comprises the primary antenna (18A) which is securely fastened to the dish (16). The primary antenna (18A) comprises the primary antenna base (18AA) which is securely attached to the dish plate (16A). The secondary right antenna (18B) further comprises the secondary right antenna bracket (18BA) which functions to permit adjustment of the secondary right antenna (18B).

The disk antenna (10) further comprises at least one secondary left antenna (18C) which is securely fastened to the dish (16). The secondary left antenna (18C) further comprises the secondary left antenna bracket (18CA) which functions to permit adjustability of the secondary left antenna (18C).

The disk antenna (10) further comprises a cable (20) electrically connected to the dish cone (16B) and the primary antenna (18A) and the at least one secondary antenna.

Figure 4:
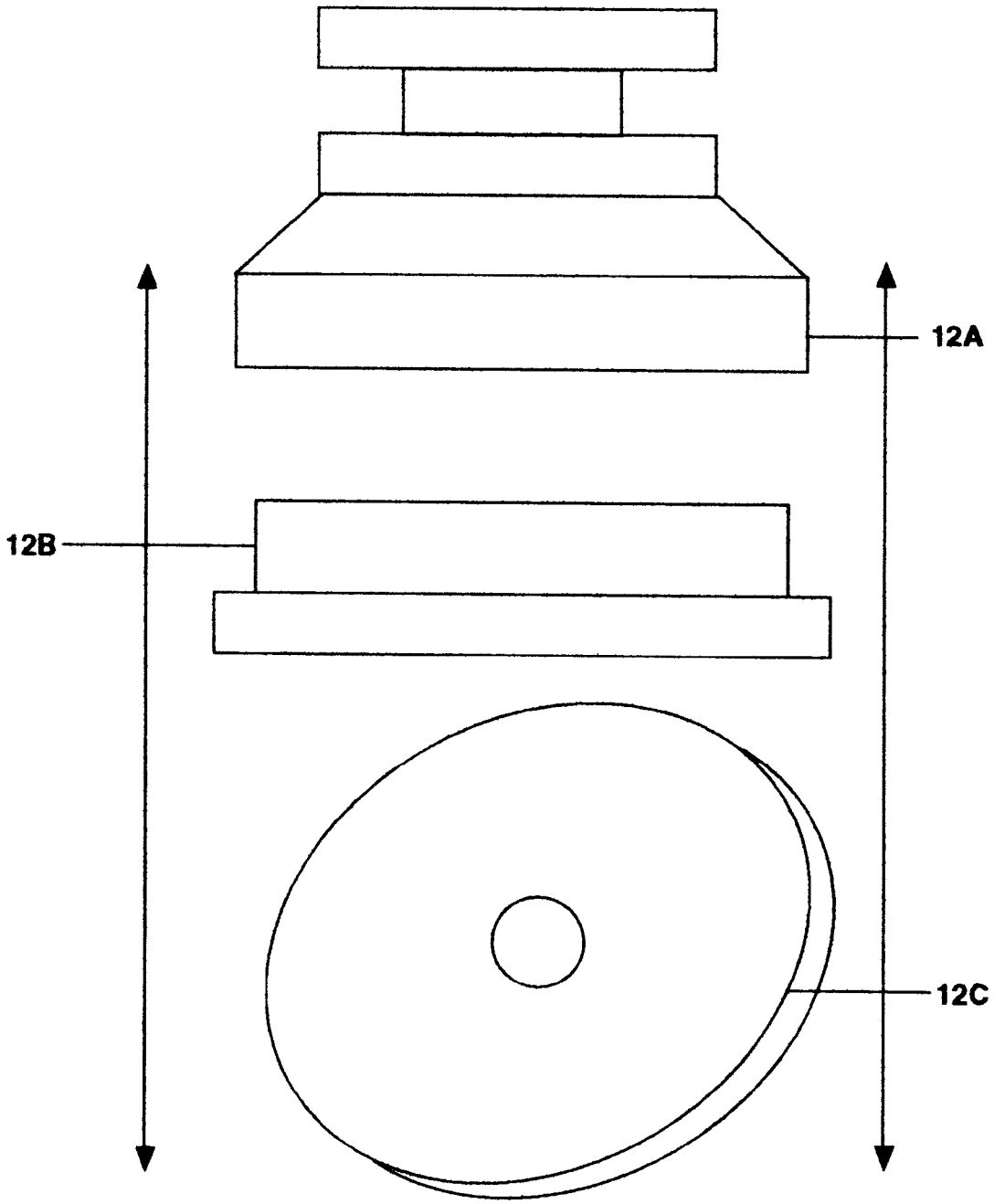
FIG. 4 is an exploded view of a base.

Lastly, referring to FIG. 4 is an exploded view of a base (12). The disk antenna (10) comprises a base (12). The base (12) comprises the base housing (12A) with the base insert (12B) removably insertable therein. The base (12) further comprises the base weight (12C) which is securely attached to a bottom surface of the base insert (12B). The base (12) further comprises the base opening (12D) in communication with the hollow post (14).

It will be understood that each of the elements described above, or two or more together, may also find a useful application in other types of constructions differing from the type described above.

While the invention has been illustrated and described as embodied in a disk antenna, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A disk antenna (10) comprising:

A) a base (12) which comprises a base housing (12A) with a base insert (12B) removably insertable therein, the base (12) further comprises a base weight (12C) securely attached to a bottom surface of the base insert (12B), the base (12) further comprises a base opening (12D) in communication with the hollow post (14), the base opening (12D) functions to receive a cable (20) therethrough;

B) a hollow post (14) securely fastened at a bottom distal end to the base extending upwardly therefrom, the post (14) comprises a post base (14A) securely connected at a bottom distal end to the base (12) and rotatably connected at a top distal end to a bottom distal end of a post head swivel (14BA) which is rotatably connected at a top distal end to a bottom distal end of a post head (14B) which is securely connected at a top distal end to the dish (16);

C) a dish (16) which comprises a dish plate (16A) having a dish cone (16B) centrally located therein, the dish (16) is securely attached to a top distal end of the post (14), the dish cone (16B) further comprises a dish cone opening (16BA) longitudinally disposed therein which functions to accept a fastener which attaches the dish cone (16B) to the dish plate (16A), the dish (16) is rotatably connected to the post (14) permitting dish swivel (16C);

D) a primary antenna (18A) securely fastened to the dish (16), the primary antenna (18A) comprises a primary antenna base (18AA) securely attached to the dish plate (16A);

E) at least one secondary antenna securely fastened to the dish (16);

F) a cable (20) electrically connected to the dish cone (16B) and the primary antenna (18A) and the at least one secondary antenna.

2. The disk antenna (10) as described in claim 1, wherein the post (14) further comprises a post access cover (14C).

3. The disk antenna (10) as described in claim 1, wherein the at least one secondary antenna comprises a secondary right antenna (18B) having a secondary right antenna bracket (18BA) which functions to permit adjustability of the secondary right antenna (18B).

4. The disk antenna (10) as described in claim 1, wherein the at least one secondary antenna comprises a secondary left antenna (18C) having a secondary left antenna bracket (18CA) which functions to permit adjustability of the secondary left antenna (18C).

* * * * *